United States Patent [19]

Aragona

[11] Patent Number: 4,465,273

[45] Date of Patent: Aug. 14, 1984

[54] PUNCHING BAG APPARATUS AND SUPPORTING MEANS

[76] Inventor: Louis Aragona, 11 Scheiber Ter., Cedar Grove, N.J. 07009

[21] Appl. No.: 451,868

[22] Filed: Dec. 21, 1982

[51] Int. Cl.[3] ..... A63B 69/22

[52] U.S. Cl. ..... 272/78

[58] Field of Search ..... 272/78, 77, 76, 55 R, 272/55 A, 112; 248/318

[56] References Cited

U.S. PATENT DOCUMENTS

| | | | |
|---|---|---|---|
| 1,116,091 | 11/1914 | McDonald | 272/78 |
| 1,744,594 | 1/1930 | Trzeniewski | 272/78 |
| 2,184,453 | 12/1939 | Hayes | 272/78 |
| 2,252,758 | 8/1941 | Bulloch | 272/76 |
| 3,218,068 | 11/1965 | Warman | 272/62 |
| 3,738,650 | 6/1973 | Ossenkop | 272/62 |
| 3,890,049 | 6/1959 | Lewis | 272/78 |
| 4,209,168 | 6/1980 | Partlow | 272/78 |
| 4,364,558 | 12/1982 | Aragona | 272/78 |
| 4,405,127 | 9/1983 | Miller | 272/62 |

*Primary Examiner*—Richard C. Pinkham
*Assistant Examiner*—T. Brown
*Attorney, Agent, or Firm*—Anthony F. Cuoco

[57] ABSTRACT

The apparatus disclosed includes a punching bag member having a body portion and a neck portion. A supporting member engages the neck portion and is retained by a bracket mounted on a longitudinally extending member. The longitudinally extending member is secured to a vertical supporting structure. The arrangement is such that the bracket is mounted in cantilever-like fashion so that the punching bag member is supported away from the vertical supporting structure and offers resistance to the user when the body portion is struck, and automatically returns to its normal position.

12 Claims, 11 Drawing Figures

PUNCHING BAG APPARATUS AND SUPPORTING MEANS

BACKGROUND OF THE INVENTION

Punching bags are generally constructed of an expensive leather exterior which covers an inflated rubber bladder. These bags require special attachments which are inserted into a swivel hook bag holder permanently affixed to a platform or the like from which the bag is suspended. Apparatus of this type is expensive and is directed toward the experienced user.

A need exists for a punching bag member and support means therefor directed toward the inexperienced user and featuring simplified construction. Copending U.S. application Ser. No. 249,344 filed by the present inventor on Mar. 31, 1981 (now U.S. Pat. No. 4,364,558) accomplishes this purpose by providing punching bag apparatus which may be suspended in a door frame or between two vertical members, as the case may be. While economical in construction and simple to install this apparatus has the disadvantage of being limited to use with the two vertical members.

Accordingly, it is an object of the present invention to provide punching bag apparatus and supporting means particularly directed to the inexperienced user which is economical in construction and simple to install, and is advantageous over like apparatus now known in the art in that it is supported on a single vertical member.

SUMMARY OF THE INVENTION

This invention contemplates punching bag apparatus and means for supporting the apparatus on a vertical structure. A punching bag member, which may be molded or otherwise fabricated of a suitable plastic material so as to form a substantially hollow member, has a body portion which is struck by the user and a neck portion which is adapted to engage a supporting member which may be a pair of wires or other suitably resilient members twisted together for providing a resilient open central portion for engaging the punching bag member and extending therefrom on both sides thereof. The supporting member is adapted at its ends for being supported by a bracket mounted to the vertical structure in cantilever-like fashion, whereby the bag member is supported away from the vertical structure. Resistance is offered to the user when the body of the punching bag member is struck, and said member automatically returns to its normal position when the striking is discontinued.

DETAILED DESCRIPTION OF THE INVENTION

Figure 1:
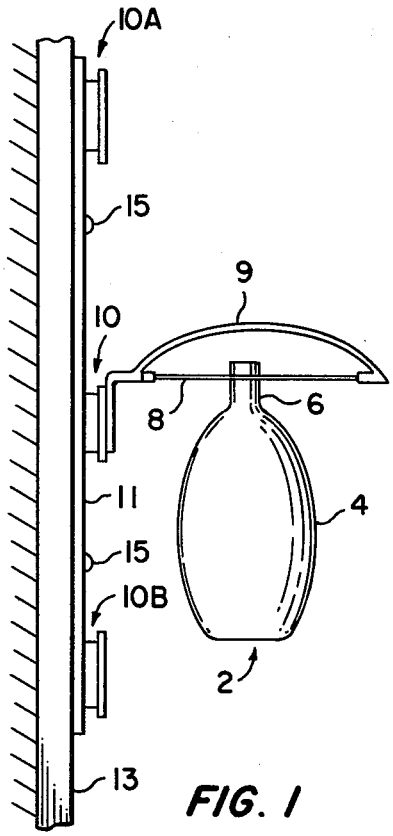
FIG. 1 is a diagrammatic respresentation generally showing punching bag apparatus and supporting means according to the invention.

With reference first to FIG. 1, the invention disclosed includes a punching bag member designated generally by the numeral 2 and including a body portion 4 and neck portion 6. Punching bag member 2 may be molded or otherwise fabricated from a suitable, thin gauge plastic material such as polyethylene or the like for providing a relatively rigid hollow member. In these respects member 2 is not unlike commercially available plastic containers which contain soft drinks and other liquids for sale to the consumer.

Neck portion 6 of punching bag member 2 is supported by a supporting member 8 so that the bag member extends substantially normal to the supporting member and substantially central thereto. Supporting member 8 extends from neck portion 6 in opposite directions and is retained by a generally arcuate bracket 9. Bracket 9 is removably retained by an adapter 10 mounted to a longitudinally extending member 11. Member 11 is removably supported on a vertical supporting structure 13 via members 15. Other adapters 10A and 10B may be mounted along the length of longitudinally extending member 11 to retain bracket 9, supporting member 8 and hence punching bag member 2 at different heights as will now be appreciated.

In this connection it is noted that vertical supporting structure 13 may be a wall, part of a door frame, a post, or any other such member suitable for use with the invention, as the case may be.

Figure 2:
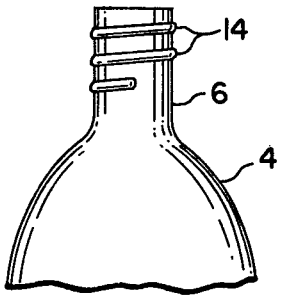
FIG. 2 is a diagrammatic representation showing one embodiment of the invention, wherein the neck portion of a punching bag member shown in FIG. 1 has protrusions thereon for engaging the supporting means.
Figure 3:
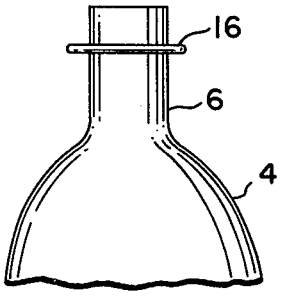
FIG. 3 is a diagrammatic representation of another embodiment of the invention, wherein the neck portion of the punching bag member has a flange thereon for engaging the supporting means.

Neck portion 6 of punching bag member 4 is adapted for receiving supporting member 8 as shown with reference to FIGS. 2 and 3. Supporting member 8 is specifically shown in FIG. 4.

Thus, with reference to FIG. 2, neck portion 6 of member 4 is seen as having a plurality of protrusions 14 extending circumferentially around the neck and in this regard the neck portion resembles the neck portion of the aforenoted liquid containers, whereby a cap is screwed on to the extending protrusions or threads to close and seal the containers.

With reference to FIG. 3, neck portion 6 of punching bag member 4 is seen as including a flange 16 disposed substantially below the top of the neck and extending circumferentially therearound.

Figure 8:
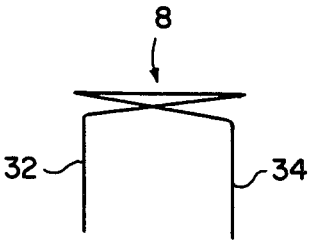
FIG. 8 is an end view of the supporting member, the top view of which is shown in FIG. 4.
Figure 4:
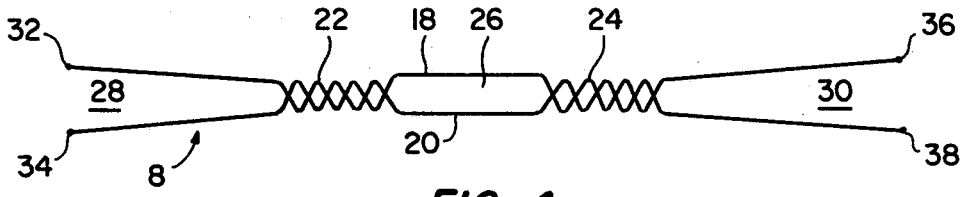
FIG. 4 is a diagrammatic top view representation of a supporting member for the punching bag member according to the invention.

With reference to FIG. 4, supporting member 8 is seen as including a pair of resilient members 18 and 20, and which members may be wires of a suitable gauge and material so as to have the appropriate resiliency for purposes which will hereinafter become evident. Wires 18 and 20 are arranged so that they are twisted together to form a unitary member at 22 and 24, with the wires being in spaced relation at their central portion 26; at an end portion 28 extending in one direction beyond twisted portion 22; and at the opposite end portion 30 extending in the opposite direction beyond twisted portion 24. The wires terminate at ends 32, 34 and 36, 38, and which ends may be bent substantially normal to the extending portions of the wires as shown in FIG. 8.

Thus, with continued reference to FIG. 4, central portion 26 of supporting member 8 coacts with protrusions 14 on neck portion 6 as shown in FIG. 2, or with flange 16 as shown in FIG. 3, to support punching bag member 2, and ends 32, 34 36 and 38, are received by bracket 9 for supporting the arrangement as shown generally in FIG. 1.

Figure 5:
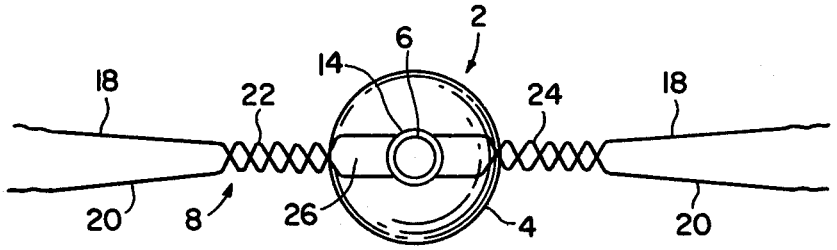
FIG. 5 is a top view diagrammatic representation showing the neck portion of the punching bag in accordance with FIG. 2 engaging the supporting member as shown in FIG. 4.
Figure 6:
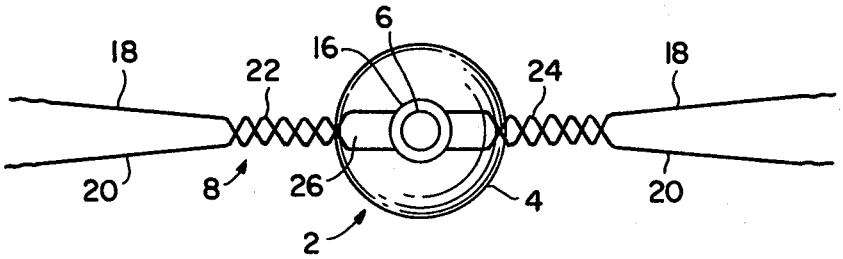
FIG. 6 is a diagrammatic top view representation showing the neck portion of the punching bag member in accordance with FIG. 3 engaging the supporting member as shown in FIG. 4.

With reference to FIGS. 5 and 6, central portion 26 of supporting member 8 may be spread apart either by the fingers of a user or with an appropriate tool such as a screw driver or the like. Thereafter, the central portion is slipped over protrusions 14 (FIG. 2) or flange 16 (FIG. 3), after which the two wires 18 and 20 forming central portion 26 are released so as to snap under the protrusions or the flange as the case may be, whereby punching bag member 4 is supported with its axis substantially normal to the axis of supporting member 8 when the member is at a level or horizontal position as shown in FIG. 1.

Figure 7:
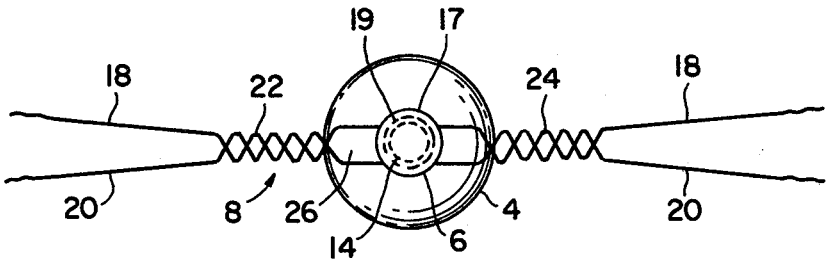
FIG. 7 is a diagrammatic top view representation showing the neck portion of the punching bag member in accordance with FIG. 2 and an adapter for the neck portion engaging the supporting member shown in FIG. 4.

In a form of the invention shown in FIG. 7, a metal or plastic cap or the like 17 is disposed in central portion 26 of supporting member 8 aforenoted, and may be affixed thereto as by cementing, soldering or brazing or the like. Cap 17 has internal threads 19 which coact with external threads 14 on neck 6 of punching bag member 2, wherein member 2 is supported by member 8. In this connection it will be understood that cap 17 will accommodate a particular size neck 6 as may be advantageous in praacticing the invention.

Figure 11:
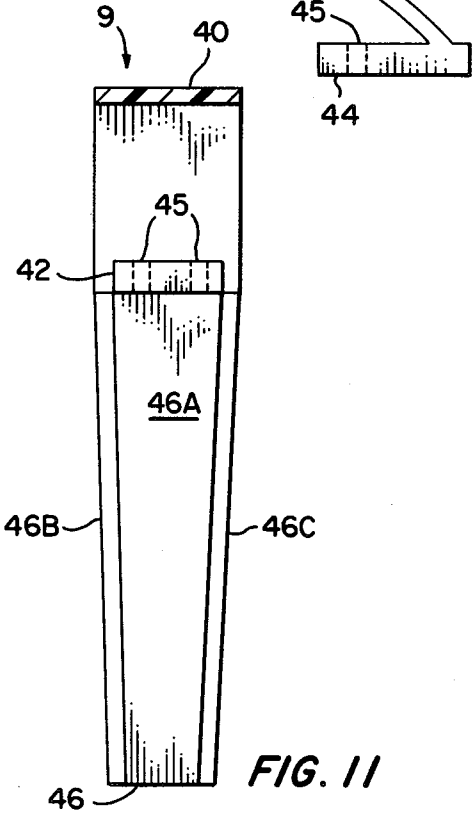
FIG. 11 is a sectional view taken along the line 11—11 in FIG. 10.
Figure 10:
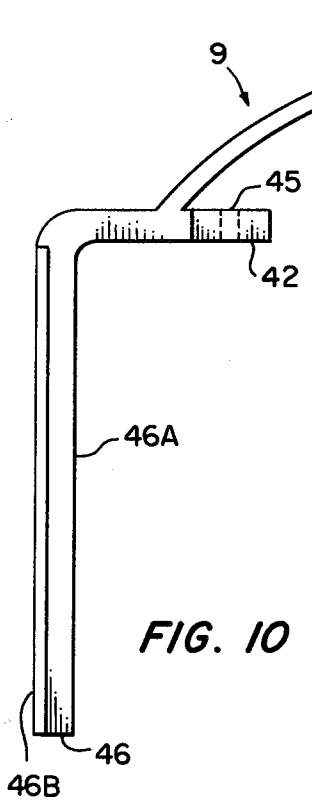
FIG. 10 is a side view of the bracket shown in FIG. 9.

Bracket 9, shown generally in FIG. 1 and more particularly in FIGS. 10 and 11, is a generally arcuate member 40 terminating in inwardly extending lips 42 and 44. Lips 42 and 44 each carry a pair of through holes 45 which receive ends 32, 34 and 36 and 38 of supporting member 8 (see FIG. 8) for retaining the supporting member.

One end of the arcuate member 40 has a longitudinally extending downwardly tapering leg 46 integral therewith. Leg 46 has a relatively thick central section 46A with relatively thin sections 46B and 46C on either side of central section 46A.

Bracket 9 is preferably of a suitable molded plastic material to best serve the purposes of the invention.

Figure 9:
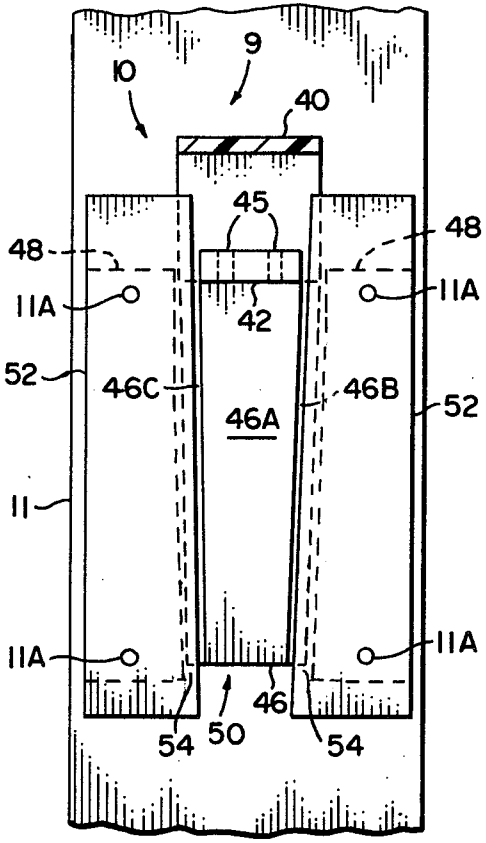
FIG. 9 is a front plan view of a bracket mounted in cantilever-like fashion through an adapter on a longitudinally extending member supported on a vertical structure, whereby the punching bag member is supported away from the vertical structure.

Adapters 10, 10A and 10B are as particularly shown in FIG. 9, wherein adapter 10 is shown for illustration purposes.

Thus, adapter 10 includes a first pair of longitudinally extending side members 48 in lateral spaced relation and downwardly tapering to form a downwardly tapering channel 50. The taper of channel 50 corresponds to the taper of leg 46 of bracket 9.

Adapter 10 further includes a second pair of longitudinally extending side members 52 overlaying respective side members 48 and having a like taper. The inner edges of side members 52 extend beyond the inner edges of respective side members 48 to form guideways 54 for purposes to be next described.

With continued reference to FIG. 9, the lower (narrow) end of leg 46 of bracket 9 is inserted into the upper (wide) end of channel 50 and the leg is urged downward in the channel, guided by guideways 54. As the leg is urged downward, the corresponding tapers of the leg and side members 48 cause the edges of said leg and side members to slidingly engage, whereby leg 46 and hence bracket 9 is firmly but removably retained by adapter 10, 10A, 10B, as the case may be. The bracket may be removed from the adapter by exerting an upward force thereon.

For the above purpose, adapters 10, 10A, 10B may likewise be of a suitable molded plastic material, and members 48 and 52 may be suitably secured to longitudinally extending member 11 as by securing elements 11A.

It will be understood that the generally arcuate shape of bracket 9 is such to provide adequate clearance for neck 6 of punching bag member 4 as is necessary for the proper operation of the invention as will be next described.

Thus, with punching bag member 2 supported by supporting member 8 and supporting member 8 supported on vertical supporting structure 13 via bracket 9, adapter 10 (10A, 10B) and longitudinally extending member 11 as heretofore described, when body 4 of punching bag member 2 is struck by the user the bag acts much like a conventional punching bag, and when the striking ceases it quickly returns to its normal rest position. Moreover, the punching bag member is simple to install and can be installed in a variety of places without elaborate structure required for this purpose.

Due to the nature of supporting member 8, wire members 18 and 20 included therein may be of indeterminable length, and their ends may be bent at right angles to their extending portions by the user as shown in FIG. 8 to accommodate, commensurate with the spacing between lips 42 and 44 on bracket 9, various cantilever extensions of the bracket, as the case may be. Further the supporting means may be height adjustable via adapters 10, 10A 10B and does not require an elaborate mechanism for accomplishing the purposes intended, as has been the case with other punching bag equipment for like purposes.

Moreover, the resiliency of wire members 18 and 20 may be varied, depending upon the strength and age of the user so that more or less resistance is provided when the bag is struck as will be understood by those skilled in the art.

The punching bag arrangement as heretofore described is useful in developing special skills in the boxing arts and developing hand and eye coordination, and hence may be readily adapted to a physical fitness, physical therapy or rehabilitation programs, as the case may be. The punching bag apparatus disclosed is not intended to replace the conventional punching bag and platform employed by professionals, but is rather intended to provide an economical and simple device to serve the purposes aforenoted.

Having thus described the invention, what is claimed is:

1. Punching bag apparatus and supporting means therefor, comprising:

a punching bag member having a body portion adapted for being struck by a user and a neck portion adapted for engaging a supporting member;

the supporting member including a pair of elongated wire-like members which are twisted at opposite ends so that said wire-like members are unitary, with the twistings on one end being in spaced relation with the twistings on the opposite end to form a centrally disposed resilient portion for engaging the neck portion of the punching bag member so that said member offers resistance when the body portion thereof is struck by the user and automatically snaps back to the rest portion, said elongated wire-like members having portions extending in opposite directions from the centrally disposed resilient portion;

a bracket;

means for removably mounting the bracket in cantilever-like fashion to a vertical supporting structure; and the portions of the supporting member extending in opposite directions from the centrally disposed resilient portion being adapted at their ends for being supported by the bracket.

2. Punching bag apparatus and supporting means therefor as described by claim 1, wherein the neck portion of the punching bag member adapted for engaging a supporting member includes:

the neck portion haing thread-like protrusions extending externally therearound; and the supporting member coacting with the neck portion so that said neck portion snaps into the centrally disposed resilient portion when the elongated wire-like members are forced apart at the centrally disposed resilient portion to provide an opening for the neck portion, and the portions of the elongated wire-like members forming said opening being retained by the thread-like protrusions.

3. Punching bag apparatus and supporting means therefor as described by claim 1, wherein the neck portion of the punching bag member adapted for engaging a supporting member includes:

the neck portion having a flange extending therearound; and the supporting member coacting with the neck portion so that said neck portion snaps into the centrally disposed resilient portion when the elongated wire-like members are forced apart at the centrally disposed resilient portion to provide an opening for the neck portion, and the portions of the elongated wire-like members forming said opening are retained by the flange.

4. Punching bag apparatus and supporting means therefor as described by claim 1, including:

the neck portion of the punching bag member adapted for engaging a supporting member having thread-like protrusions extending externally therearound;

a cap which snaps into the centrally disposed resilient portion when the wire-like members are forced apart at the centrally disposed resilient portion to provide an opening for the cap, said cap having thread-like protrusions extending internally therearound; and the external thread-like protrusions on the neck portion of the punching bag member engaging the internal thread-like protrusions on the cap, whereby the punching bag member is supported by the supporting member.

5. Punching bag apparatus and supporting means therefor as described by claim 4, including:

the cap being affixed to the centrally disposed resilient portion.

6. Punching bag apparatus and supporting means therefor as described by claim 1, wherein:

the bracket is a generally arcuate member terminating at each of its ends in inwardly extending lips; and the lips including means for retaining the ends of the supporting member extending in opposite directions from the centrally disposed resilient portion, which ends are adapted for being retained by the bracket.

7. Punching bag apparatus and supporting means therefor as described by claim 6, wherein:

the ends of the supporting member are substantially normal to said member; and the means included on the lips for retaining said ends includes holes in the lips for receiving the substantially normal ends.

8. Punching bag apparatus and supporting means therefore as described by claim 1, wherein the means for removably mounting the bracket in cantilever-like fashion to a vertical supporting structure includes:

one end of the bracket having a longitudinally extending downwardly tapering leg integral therewith;

an adapter having a longitudinally extending downwardly tapering channel, said channel taper corresponding to the taper of the bracket leg; and the tapering channel receiving the tapering leg, whereby the sides of the leg slidingly engage the sides of channel when the leg is urged in the channel to removably retain the leg in the channel and to mount the bracket in cantilever-like fashion to the supporting structure.

9. Punching bag apparatus and supporting means therefor as described by claim 8, including:

a longitudinally extending member removably secured to the vertical supporting structure;

the adapter secured at a particular height on the longitudinally extending member so as to mount the bracket at said height; and other adapters secured on the longitudinally extending member at heights above and below the first mentioned adapter for alternatively mounting the bracket at said heights.

10. Punching bag apparatus and supporting means therefor as described by claim 8, wherein the adapter includes:

a first pair of longitudinally extending side members in lateral spaced relation and downwardly tapering to form the downwardly extending tapering channel;

a second pair of longitudinally extending side members in lateral spaced relation and downwardly tapering in correspondence to the downwardly tapering of the first pair of said members, and overlaying corresponding members of the first pair of members;

the inner edges of the second pair of side members extending beyond corresponding inner edges of the first pair of side members to form guideways; and the tapered leg being guided by the guideways when said leg is urged in the channel.

11. Punching bag apparatus and supporting means therefor as described by claim 10 wherein:

the brcket leg has a relatively thick central section with relatively thin side sections on either side of the central section; and the side sections of the bracket leg being guided by the guideways when said leg is urged in the channel.

12. Punching bag apparatus and supporting means therefor as described by claim 1, wherein:

the punching bag member is a hollow, relatively rigid container like member.

* * * * *